United States Patent [19]

Woodard, Jr. et al.

[11] Patent Number: 4,534,846

[45] **Date of Patent: * Aug. 13, 1985**

[54] ELECTRODES FOR ELECTROLYTIC CELLS

[75] Inventors: Kenneth E. Woodard, Jr., Cleveland, Tenn.; Ronald L. Dotson, Cheshire, Conn.

[73] Assignee: Olin Corporation, Cheshire, Conn.

[ * ] Notice: The portion of the term of this patent subsequent to Jun. 5, 2001 has been disclaimed.

[21] Appl. No.: 674,373

[22] Filed: Nov. 23, 1984

Related U.S. Application Data

[60] Continuation-in-part of Ser. No. 518,595, Jul. 29, 1983, Pat. No. 4,513,904, which is a division of Ser. No. 490,612, May 2, 1983, Pat. No. 4,452,685.

[51] Int. Cl.[3] ..... C25B 11/00; C25C 7/02

[52] U.S. Cl. ..... 204/290 R; 204/284; 204/286; 204/288; 204/290 F

[58] Field of Search ..... 204/284, 286, 288, 290 R, 204/290 F

[56] References Cited

U.S. PATENT DOCUMENTS

| | | | |
|---|---|---|---|
| 3,233,034 | 2/1966 | Grabbe | 174/68.5 |
| 3,829,601 | 8/1974 | Jeannotte et al. | 174/68.5 |
| 4,255,012 | 3/1981 | Parent et al. | 339/242 |
| 4,312,737 | 1/1982 | Kircher | 204/284 |
| 4,452,685 | 6/1984 | Woodward | 204/278 |

OTHER PUBLICATIONS

Data Sheet, "Use of Westinghouse LR-1 Joint Compound", (Jul. 1983).

*Primary Examiner*—John F. Niebling

*Attorney, Agent, or Firm*—Ralph D'Alessandro; Donald F. Clements; Thomas P. O'Day

[57] ABSTRACT

An electrode for use in an electrolytic cell, wherein the electrode comprises a conductor and an element of a second metal, at least a portion of each having contact surfaces being held in intimate contact with the other, said conductor and said element each having a conductive coating applied to the contact surface, said conductive coating comprising between about 20 and about 30 percent indium and between about 80 and about 70 percent gallium, whereby the contact resistance between said conductor and said element is reduced.

16 Claims, 5 Drawing Figures

ELECTRODES FOR ELECTROLYTIC CELLS

BACKGROUND OF THE INVENTION

This application is a continuation-in-part application of USSN 518,595, filed July 29, 1983, U.S. Pat. No. 4,513,904 which is a division of USSN 490,612 filed May 2, 1983, now U.S. Pat. No. 4,452,685.

This invention relates to an improved electrode for use in chlor-alkali electrolytic cells.

In view of the phenomenal jump of energy prices and increased scarcity of industrial fuel supplies, there has been continuous activity in the electrolysis field to find ways to reduce the amount of power used in electrolytic processes. In the chlor-alkali industry, such activity has been concerned with the development of dimensionally stable anodes, catalytic cathodes and advanced membrane cell structures, all of which, when combined, have resulted in signficant decreases in the amount of energy required to produce a ton of product.

In such cells, it is most important that the current density within the volumetric space between the anodes and the cathodes be as uniform as possible. This both minimizes wear and tear on the membrane and tends to maximize the production rate within the cell, all other conditions being equal. Such a condition is achieved by using anodic and cathodic structures which are adapted to uniformly distribute power across the surface area of the electrode. This is generally accomplished by building into the anode and cathode structures at least one, but more usually a plurality of central internal conductors normally of copper which are adapted to act as extensions of the associated bus bar power distribution system and promote even distribution of electric current throughout the external portions of the electrode structure.

In the design and operation of such a system, it is found that one factor which tends to limit the absolute quantity of current which can be so distributed is the contact resistance between the central conductors and the contiguous electrode structure. The materials used for such a structure, normally titanium for anodes and nickel for cathodes, have substantially different electric conductivities as compared to copper. Further, in the case of titanium and nickel, there is a strong tendency to build up a thin oxide layer on the exposed surfaces, this layer being relatively nonconductive and resulting in rather significant contact resistance values between a central conductor and the external electrode structure.

Responding to this recognition of the effect of oxide layers on contact resistance between contact surfaces a number of attempts have been made to produce electrode structures having lower contact resistance. These attempts include such techniques as plating or coextruding an external coating of nickel or titanium onto the central copper conductor and then welding or bonding in some way the rest of the structure onto this external coating. In other designs, a thin film of copper may be sputtered onto the mating surfaces of the nickel and titanium electrode components to establish a nominally low resistance Cu-Cu couple at this interface. In still other cases, the components are tightly clamped together so that physical pressure tends to cause the oxide layer to break up, thus reducing the effective contact resistance between them. Such techniques have proven to be reasonably effective but can be expensive to implement. Further, with the trend towards higher power levels in chlor-alkali electrolytic cells, it has become more difficult to achieve them without eventually causing other problems in cell operation.

The aforementioned problems are solved in the application and design of the present invention by applying an electrically conductive coating of predetermined liquid-metal mixture content between the contact surfaces of a generally flat, planar conductor plate and a generally flat, planar corrosion resistant element of an electrode of an electrolytic cell.

SUMMARY OF THE INVENTION

It is an object of this invention to provide an electrode having a lower electrical contact resistance between its components.

It is a further object of this invention to provide a method for reducing the electrical contact resistance between copper and titanium or nickel in an electrode.

It is a feature of the present invention that the electrical conductor is bonded to the corrosion-resistant element of the electrode along a contact surface that is coated with a conductive coating that reduces the electrical contact resistance within the electrode.

It is another feature of the present invention that the conductive coating is applied over only a portion of the contact surface between the element of the electrode and the electrical conductor immediately opposite the conducting ribs or risers of the electrode.

It is still another feature of the present invention that the conductive coating is a liquid-metal mixture comprised of between about 20 and 30 percent indium and about 80 and about 70 percent gallium.

It is an advantage of the present invention that the contact resistance between the electrical conductor and the corrosion-resistant element of the electrode is reduced.

It is another advantage of the present invention that the lower electrical contact resistance is achieved in a simple and low-cost manner.

These and other objects, features and advantages are obtained in an electrolytic cell by providing a conductive coating of a liquid-metal mixture comprised of between about 20 and 30 percent indium and about 80 and 70 percent gallium over at least a portion of the contact surfaces between the electrical conductor and the corrosion-resistant element of the electrode to reduce the electrical contact resistance of the electrode.

DETAILED DESCRIPTION OF THE INVENTION

Figure 1:
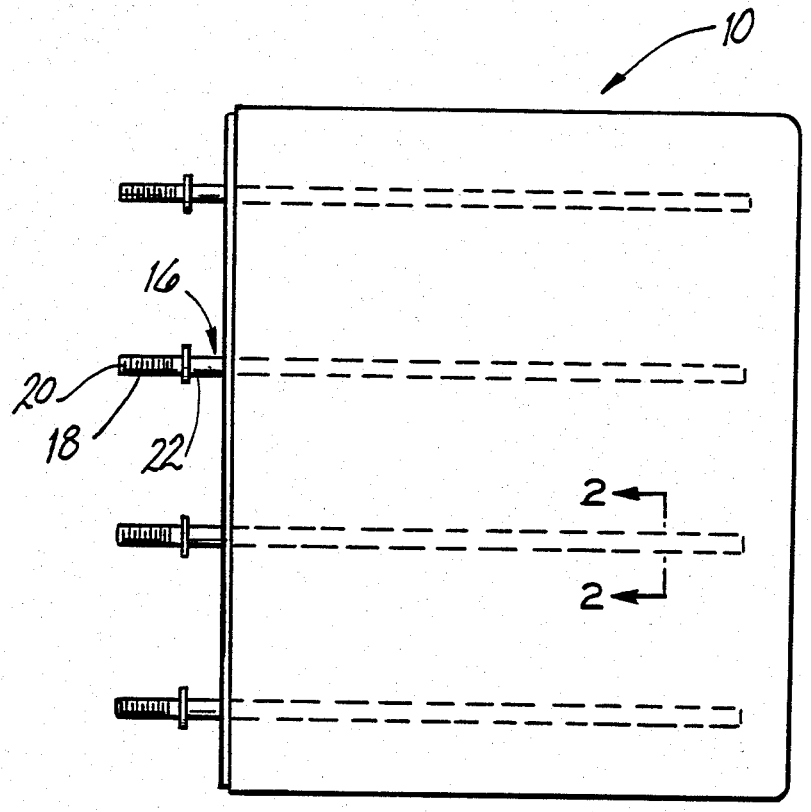
FIG. 1 is a front view of an exemplary electrode assembly as used in a chlor-alkali cell.
Figure 2:
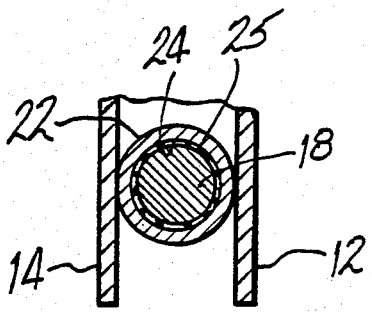
FIG. 2 is a cross sectional view of the central conductor of FIG. 1 along the line 2—2.

The present invention can best be understood by reference to an exemplary structure to which it is applied. This is an electrode of a type described for use in a chlor-alkali cell as shown in U.S. Pat. No. 4,222,831 issued to Specht et al on Sept. 16, 1980, which is incorporated by reference in relevant part. As shown in FIGS. 1 and 2, electrode 10 comprises basically an envelope having a front electrode surface 12 and a back electrode surface 14, said electrode surfaces being either of a solid, mesh, expanded metal or foraminous nature.

Emplaced within the interior of electrode 10 is at least one, but more usually a plurality of central power distributors 16 which comprise an internal conductor 18, preferably of copper, extending substantially across the width of electrode 10. In the embodiment illustrated, this is threadingly adapted at its outermost end 20 to engage a bus bar or cable from an external power system (not shown).

In the preferred embodiment for this invention, the external portions of said front and back electrode surfaces 12 and 14 for anodic use are made from titanium and for cathodic use are made from nickel. Typical materials utilized for internal conductor 18, anode surfaces and cathode surfaces, respectively, are copper C 110, nickel 200 and commercial titanium (Grade 1). Nominal compositions quoted for these materials are:

| | | |
|---|---|---|
| Copper (C 110) | Cu | 99.9% (min.) |
| | O | 0.005% (max.) |
| Nickel (200) | Ni + Co | 99.0% (min.) |
| | C | 0.15% (max.) |
| | Cu | 0.25% (max.) |
| | Fe | 0.40% (max.) |
| | Mn | 0.35% (max.) |
| | Si | 0.35% (max.) |
| | S | 0.01% (max.) |
| Titanium (Gr. 1) | Ti | 99.6% (min.) |
| | N | 0.3% (max.) |
| | C | 0.10% (max.) |
| | H | 0.015% (max.) |
| | Fe | 0.2% (max.) |
| | O | 0.18% (max.) |

However, other similar metals may be used if desired.

As shown in FIG. 2, internal conductor 18 is surrounded by an external element 22 which is a concentric, intimate physical sheath in contact with internal conductor 18. External element 22 is also in more or less continuous electrical contact with front and back surfaces 12 and 14.

Both nickel and titanium are known to form tightly adherent surface oxide layers which will act to electrically insulate the interior contact surface of element 22 from the mating exterior surface of internal conductor 18. This acts to raise the contact resistance between the two, thus increasing the voltage drop across interstitial area 24.

In the process of this invention, such contact resistance losses between internal conductor 18 and external element 22 are substantially reduced by coating the mating contact surfaces of conductor 18 and element 22 with a thin layer of a conductive coating 25 to fill interstitial area 24. Conductive coating 25 is a liquid-metal mixture comprised of between about 20 and about 30 percent indium by weight and between about 80 and about 70 percent gallium by weight, and preferably between about 23 and about 26 percent indium and between about 77 and about 74 percent gallium. Conductive coating 25 is a highly fluid eutectic having a melting point of aproximately 18° C. so that it can be easily applied to the surfaces even at room temperature. Further, unlike mercury or other low melting alloys, conductive coating 25 does not immediately amalgamate or otherwise act to bond conductor 18 and external element 22 together.

Conductive coating 25 is preferably applied to relatively clean surfaces and may be wiped on with a suitable applicator such as a paint brush, cotton swab or wiping cloth. For larger area, squeegees or suitably designed spray equipment may also be used.

Where the contact surfaces are contaminated, some degree of precleaning is required to promote good wetting. For light dirt, this may comprise operations such as degreasing or washing with strong detergents. For more heavily contaminated surfaces, particularly heavily oxidized surfaces, acid etching or a light dressing with an abrasive-containing material, such as an abrasive impregnated foam or fine sandpaper having grit size between about 80 and about 400, may also be utilized. Further, it is found that where the abrasive containing material itself is either impregnated or coated with the conductive coating, oxide removal and application can be conducted more or less simultaneously. All of these operations can be conducted at room temperature due to the low melting point of the eutectic composition. The surfaces should be dry prior to application of the conductive coating and any debris or excess coating material remaining after the surfaces have been evenly coated must be removed.

To minimize galvanic corrosion problems resulting from contact with the anolyte or catholyte solutions, external element 22 is preferably made from the same material as that used for the contact surfaces, i.e. titanium for anodic use and nickel for cathodic use. Further, to both maximize current transfer and promote structural rigidity, external element 22 is usually welded to the front and back surfaces of the electrode.

Utilizing conductive coating 25 in accordance with the process of this invention permits the use of less costly procedures to assemble the basic electrode. Thus, for assembly of electrode 10 shown in FIGS. 1 and 2, the outer electrode surfaces 12 and 14 and external element 22 can be prefabricated without the necessity of having a built-in internal conductor 18. When such an item is needed to complete the assembly, it merely requires that the mating surfaces be coated with conductive coating 25 and the internal conductor 18 then inserted into the interior of exterior element 22 to complete the overall assembly operation. With proper tolerances, interstitial area 24 is completely filled with conductive coating 25 and good electrical contact is established without the necessity of initial, permanent physical bonding between the two structures.

It is not known exactly how conductive coating 25 works, but it is postulated that it works by filling interstitial area 24 with conductive material. Where a Light oxide is present, it appears to either dissolve or displace the oxide, thus preventing recontamination of the cleaned surface. When the compound is used to fill interstitial area 24 between surfaces of copper and nickel, it is found that the total resistance of a copper-nickel couple is reduced from between about 0.5 and about 0.6 milliohms to between about 0.07 and about 0.21 milliohms. Further, such values do not seem to change much even after long-term contact at a temperature of about 90° C., whereas uncoated couples change rapidly and drastically for the worse in times as short as four days or even less.

Figure 3:
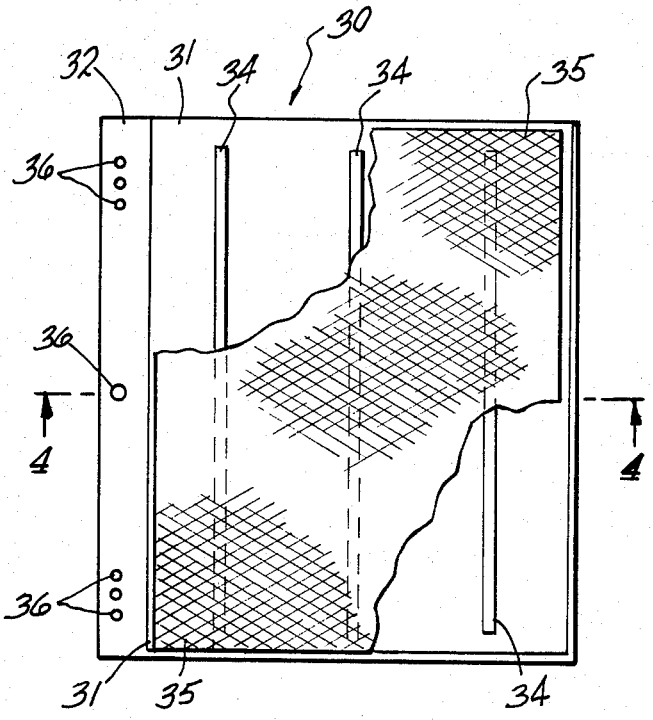
FIG. 3 is a side elevational view of an alternative embodiment of an electrode with portions of the electrode surface broken away.
Figure 4:
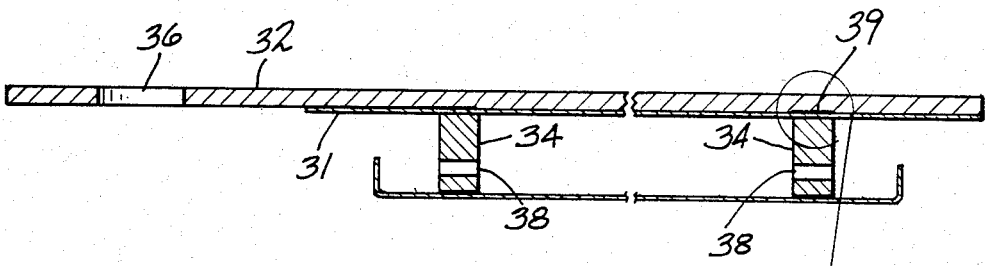
FIG. 4 is a sectional view taken along the section line 4—4 of FIG. 3.
Figure 5:
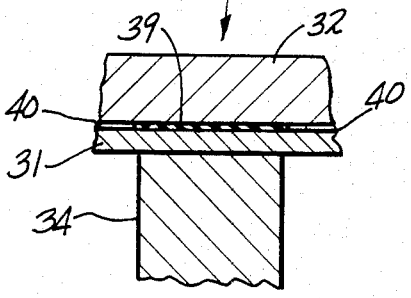
FIG. 5 is an enlarged view of the encircled portion of FIG. 4 showing the conductive coating and the contact surfaces of the electrode between the electrical conductor and the corrosion-resistant element.

FIGS. 3–5 show an alternative electrode embodiment in which the conductive coating can also be used to reduce the electrical contact resistance between two generally flat, planar contact surfaces.

An electrode, indicated generally by the numeral 30 in FIG. 3, may be either an anode or cathode depending upon the material of the corrosion-resistant element 31 applied to the electrical conductor 32 and from which the conducting ribs 34 and electrode surface 35 are made. The corrosion resistant material may be formed of nickel, stainless steel or iron in the case of the cathodes and titanium in the case of the anodes. Nickel is the preferred material for the cathode.

The conductor 32 is in the form of a flat conductor plate. Conductor 32 is formed of copper and has a series of holes 36 along one side for connection to a bus bar or intercell connectors. Appropriately fastened to conductor 32, such as by soldering, bonding or other appropriate techniques, is the corrosion-resistant element 31. As shown in FIG. 3, element 31 does not cover the entire conductor plate 32.

Element 31 has a plurality of generally vertically extending conducting ribs 34 suitably fastened, such as by welding or bonding, to it at spaced intervals across its surface. The conducting ribs 34 serve as the conductive path of the electrical current to the electrode surface 35. As seen in FIG. 4, conductive ribs 34 may have a series of apertures 38 along their length to promote the flow of electrolyte fluid across the area of the conductor plate beneath the electrode surface 35. The electrode surface 35 is suitably fastened to the conducting ribs 34, such as by welding or bonding.

As best seen in FIGS. 4 and 5, the contact surfaces between the conductor 32 and the corrosion-resistant element 31 immediately in line with and opposite the conducting ribs 34 have a layer of conductive coating 39 therebetween along the entire length of each conducting rib 34. The conductive coating 39 is normally applied to the previously cleaned copper surface of the conductor 32 until the contact surface is completely wetted by the coating. The conductive coating is a liquid-metal mixture comprised of between about 20 and about 30 percent indium and between about 80 and about 70 percent gallium. This coating effectively reduces the amount of electrical resistance between the contact surfaces of the electrical conductor 32 and the particular corrosion-resistant element 31 of either the anode or the cathode.

The space 40 adjacent the layer of electrically conductive coating 39, seen in FIG. 5, between the electrical conductor 32 and the corrosion-resistant element 31 is filled with an appropriate bonding agent (not shown) such as solder, to effect a structurally reinforcing bond between the conductor plate and the generally flat, planar plate of the corrosion-resistant element 31. The electrode surface 35 of FIGS. 3 and 4 is suitably fastened to the conducting ribs 34, such as by spot welding or bonding.

A preferred method of cleaning the copper surfaces of the electrical conductor 32 in its plate form is used prior to applying the conductive coating 39. First the copper surface is deburred, such as buffing with a soft wire wheel or brush. Any oxides present on the copper surface are then removed by degreasing with either an alkaline bath or wipe, such as weak caustic, or a vapor treatment using a commercially available caustic atmosphere. The copper surface is then cleaned with about a 12% sulfuric acid, either applied topically or in a bath, for about 10 seconds at a room temperature of about 20° C. Other concentrated acids, such as hydrochloric could also be used. The copper is then rinsed in distilled water and allowed to dry. If an oxide film appears on any part of the surface, the affected area is abraded on its surface, such as with a SCOTCHBRITE® pad of regular grade.

The copper plates are then stored in a manner that limits their exposure to air, such as by application of an adhesive paper to the surfaces or by wrapping the plates in polyethylene sheets. Paper sold under the name COPPERTEX has been especially effective for this storing step until the plates are ready for bonding.

When ready for bonding of the copper electrical conductor 32 to the plate of the corrosion-resistant element 31, the electrically conductive coating 39 is applied, preferably to the copper surface, in sufficient quantity to wet the entire contact surface area of both the conductor plate 32 and the element 31. The electrically conductive coating 39 is worked into the receiving surface, preferably with a SCOTCHBRITE® pad in a circular motion.

After application of the conductive coating 39, the conductor plate 32 and the corrosion-resistant element 31 are appropriately fastened together, ensuring the contact surfaces in line with the conducting ribs 34 are properly aligned so that the electrically conductive coating is opposite the conducting ribs 34 to create a low resistance electrical direct flow path from the conductor 32 through the electrically conductive coating 39 to the corrosion-resistant element 31 and into the conducting ribs 34. The electrical current is then distributed across the electrode surface 35.

EXAMPLE 1

Two coupons of copper C 110 strip, each being 0.045"×1"×2" were cleaned by degreasing with methanol and acid etching in a 12 weight percent $H_2SO_4$ solution for about 10 seconds to produce a material having a front to back resistance of about 0.06 milliohms. At the same time, two coupons of nickel 200 alloy, each being 0.055"×1"×2" were cleaned by vapor degreasing in methanol and acid etching in a solution comprising 37.8 milliliters $H_2O$+56.8 milliliters $H_2SO_4$+85.2 milliliters $HNO_3$ for 10 seconds at 35° C. to produce material having a front to back resistance of about 0.23 milliohms. After being rinsed with distilled water and dried, an area of about one square inch of a predesignated mating surface of one copper coupon and one nickel coupon was evenly coated with a thin layer of conductive coating 25 having a composition of about 23% indium and 77% gallium, using a cotton swab applicator after which said coated surfaces were pressed together to form a conductive copper-nickel couple. This was placed in an oven set for a nominal temperature of about 90° C. For purposes of comparison a cleaned but uncoated copper-nickel couple made from the remaining coupons was also placed in the oven. Both couples were also loaded to 10 psi to simulate both thermal and mechanical levels experienced in a typical chlor-alkali cell electrode installation. When assembled, no bonding was experienced with either couple.

The resistance across the couples was periodically measured with results as follows:

| Aging Time | Cu—Ni Couple Resistance (Milliohms) Coated | Uncoated |
|---|---|---|
| 0 days | | 0.55 |
| 1 day | 0.21 | |
| 3 days | 0.19 | |
| 4 days | | 2.80 |
| 6 days | | 63.50 |
| 8 days | 0.21 | |
| 10 days | 0.07 | |
| 11 days | | 142.5 |
| 15 days | 0.19 | |
| 17 days | | 135.6 |
| 25 days | 0.14 | |

The results of this example show that whereas the contact resistance of the untreated couple increased rapidly, that of the treated couple remained stable due to improved junction resistance with the passage of time as the alloy is diffused into the joint metals with increases in time, temperature and electrical load and may have actually decreased slightly after 25 days of testing.

EXAMPLE 2

The procedure of Example 1 was repeated with the nickel coupon being replaced with 0.0385"×1"×2" titanium (Grade 1) coupons having, after etching, a front to back resistance of about 1.75 milliohms.

| Aging Time | Cu—Ti Couple Resistance (Milliohms) Coated | Uncoated |
|---|---|---|
| 4 days | 2.60 | 170 |
| 8 days | 0.95 | 190 |

Results comparable to Example 1 were observed. Note, however, how rapidly and to what degree the electroresistant oxide coating builds up on the titanium surface.

EXAMPLE 3

The procedure of Example 2 was followed with the titanium being replaced by titanium coupons containing a 0.1 micron thick layer of copper sputtered onto the mating surface. This was cleaned using the procedure for copper as detailed in Example 1.

| Aging Time | Cu—Cu Sputtered Ti Couple Resistance (Milliohms) Coated | Uncoated |
|---|---|---|
| 0 days | | 0.4 |
| 1 day | 0.98 | 4.4 |
| 3 days | 1.03 | |
| 4 days | | 50.5 |
| 6 days | | 60.5 |
| 8 days | 0.63 | |
| 10 days | 0.64 | |
| 11 days | | 70 |
| 15 days | 0.65 | |
| 17 days | | 70 |
| 25 days | 0.85 | |

This shows that sputtering copper on titanium produces a system which, while superior to a Cu-Ti couple will still quickly break down on long-term exposure to the temperature and pressure environmental conditions of a cell to achieve uncoated contact resistance values substantially higher than those found with coated couples.

While the preferred structure in which the principles of the present invention have been incorporated is shown and described above, it is to be understood that the invention is not to be limited to the particular details thus presented, but in fact, widely different means may be employed in the practice of the broader aspects of this invention. For example, it is to be understood that although only a half electrode is shown in FIGS. 3 and 4, the electrode can equally well be a full electrode with two active surfaces on opposing sides. The full electrode may be either monopolar or bipolar. The full electrode would merely have the electrically conductive coating applied to both sides of the electrical conductor 32 and the desired corrosion-resistant element 31, the conducting ribs 34 and the particular electrode surface 35 would be fastened to the second side of the conductor 32. The scope of the appended claims is intended to encompass all obvious changes in the details, materials and arrangements of parts which will occur to one of skill in the art upon a reading of the disclosure.

What is claimed is:

1. An electrode for use in an electrolytic cell having cell electrolyte flowing through the cell, comprising in combination:

(a) a generally flat, planar conductor plate connectable to an electrical connection supplying electrical current having a contact surface;

(b) a generally flat, planar element fastened to at least a portion of the conductor plate, the element being of a material that is corrosion-resistant to the cell electrolyte and having a contact surface;

(c) conducting means fastened to the generally flat, planar element of corrosion-resistant material;

(d) an electrode surface fastened to the conducting means spaced apart from the generally flat, planar element of corrosion-resistant material; and (e) an electrically conductive coating in contact with the contact surfaces of the conductor plate and the generally flat, planar element of corrosion resistant material immediately in line and opposite the conducting means, the electrically conductive coating being a liquid-metal mixture comprising between about 20 and about 30 percent indium by weight and between about 80 and about 70 percent gallium by weight such that the electrical contact resistance between the conductor plate and the generally flat, planar element of corrosion resistant material is reduced.

2. The apparatus according to claim 1 wherein the electrode surface is foraminous.

3. The apparatus according to claim 1 wherein the electrode is an anode.

4. The apparatus according to claim 3 wherein the conductor plate is copper.

5. The apparatus according to claim 4 wherein the generally flat, planar element of corrosion-resistant material is titanium.

6. The apparatus according to claim 5 wherein the electrode surface is titanium.

7. The apparatus according to claim 1 wherein the electrode is a cathode.

8. The apparatus according to claim 7 wherein the conductor plate is copper.

9. The apparatus according to claim 8 wherein the generally flat, planar element of corrosion resistant material is nickel.

10. The apparatus according to claim 9 wherein the electrode surface is nickel.

11. The apparatus according to claim 1 wherein the conducting means are a plurality of ribs of corrosion-resistant material at spaced intervals across the generally flat, planar element of corrosion resistant material.

12. The apparatus according to claim 11 wherein the ribs are generally vertically extending along their length.

13. The apparatus according to claim 12 wherein the ribs have a plurality of flow apertures along their length.

14. The apparatus according to claim 13 wherein the ribs are titanium.

15. The apparatus according to claim 13 wherein the ribs are nickel.

16. The apparatus according to claim 1 wherein the conductor plate further has a side adapted for electrical connection to conduct electrical current.

* * * * *